US005823527A

United States Patent [19]

Burlew et al.

[11] Patent Number: 5,823,527

[45] Date of Patent: Oct. 20, 1998

[54] CONTROL FOR A SHEET STACK SUPPORTING PLATFORM

[75] Inventors: Leroy E. Burlew, Williamson; Michael T. Dobbertin, Honeoye; Guy J. Rossi, Hilton, all of N.Y.

[73] Assignee: Eastman Kodak Company, Rochester, N.Y.

[21] Appl. No.: 724,713

[22] Filed: Sep. 30, 1996

[51] Int. Cl.[6] ..... B65H 7/02

[52] U.S. Cl. ..... 271/265.02; 271/265.04; 271/30.1; 271/147; 271/171

[58] Field of Search ..... 271/30.1, 31, 147, 271/155, 171, 265.02, 265.04

[56] References Cited

U.S. PATENT DOCUMENTS

| | | | |
|---|---|---|---|
| 3,806,242 | 4/1974 | Reehil | 271/265.01 |
| 5,033,731 | 7/1991 | Looney | 271/176 |
| 5,344,133 | 9/1994 | Jantsch et al. | 271/171 |
| 5,574,551 | 11/1996 | Kazakoff | 271/171 |

FOREIGN PATENT DOCUMENTS

| | | | |
|---|---|---|---|
| 63-134448 | 6/1988 | Japan | 271/147 |
| 0069424 | 3/1989 | Japan | 271/155 |
| 403279127 | 12/1991 | Japan | 271/147 |

*Primary Examiner*—H. Grant Skaggs
*Attorney, Agent, or Firm*—Lawrence P. Kessler

[57] ABSTRACT

A sheet feeder having a platform for supporting a stack of sheets, a feed head assembly for feeding sheets seriatim from the top of a sheet supply stack supported on the platform, a mechanism for moving the platform relative to the feed head assembly, and device for controlling operation of the platform moving mechanism. The control device determines a selected parameter of a stack of sheets supported on the platform and produces a signal corresponding thereto. The speed of the platform moving mechanism is then set based on the parameter signal.

17 Claims, 5 Drawing Sheets

CONTROL FOR A SHEET STACK SUPPORTING PLATFORM

BACKGROUND OF THE INVENTION

The present invention relates in general to supporting platforms for sheet stacks for reproduction apparatus, and more particularly to a control for the sheet stack supporting platform of a reproduction apparatus which accommodates for a selected parameter of a supported sheet supply stack to maintain the topmost sheet in such supply stack in proper relation with a sheet feed head assembly.

In typical reproduction apparatus such as copiers or printers, for example, information is reproduced on individual cut sheets of receiver material such as plain bond paper or transparencies. Receiver sheets, of the various types, are stored in stacks and respectively fed seriatim from such stacks when copies are to be reproduced thereon. The sheet feeder for the reproduction apparatus must be able to handle a wide range of sheet types and sizes reliably and without damage. Sheets must be accurately fed individually from the sheet stack; that is, without misfeeds or multifeeds.

A recently described highly efficient and reliable sheet feeder is shown in U.S. Pat. No. 5,344,133, issued Sep. 6, 1994, in the name of Jantsch et al. In such apparatus, a stack of sheets is stored in a supply hopper. A sheet feed head assembly, including a plenum, a vacuum source in flow communication with the plenum, and a mechanism, such as a feed belt associated with the plenum, urges a sheet acquired by vacuum in a sheet feeding direction away from the sheet supply stack. The sheet supply stack is supported so as to maintain the topmost sheet in such stack at a predetermined level in spaced relation with respect to the urging mechanism of the sheet feed head assembly. A first positive air supply directs a flow of air at the sheet supply stack to levitate the top several sheets in the supply stack to an elevation enabling the topmost sheet to be acquired by vacuum from the sheet feed head assembly plenum; and a second positive air supply directs a flow of air at an acquired sheet to assure separation of any additional sheets adhering to such topmost sheet.

It is clear that the sheet stack must be maintained in operative relation with the sheet feed head assembly to assure desired sheet feed from the stack. In the aforementioned sheet feeder, a stack height sensor monitors the location of the topmost sheet in the stack. An platform drive then maintains that topmost sheet within an operating window relative to the sheet feed head assembly. However, the weight of the stack of sheets has an adverse effect on proper location of the stack relative to the sheet feed head assembly. That is, the drive for the sheet supply platform is subjected to different requirements for different stack weights. This is true even for a stack as it is depleted during the feeding of the sheets since the weight of the stack is consistently changing as the sheets are being fed therefrom.

SUMMARY OF THE INVENTION

In view of the foregoing discussion, this invention is directed to a sheet feeder having a platform for supporting a stack of sheets, a feed head assembly for feeding sheets seriatim from the top of a sheet supply stack on the platform, a mechanism for moving the platform relative to the feed head assembly, and device for controlling operation of the platform moving mechanism. The control device determines a selected parameter of a stack of sheets on the platform and produces a signal corresponding thereto. The speed of the platform moving mechanism is then set based on the parameter signal.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
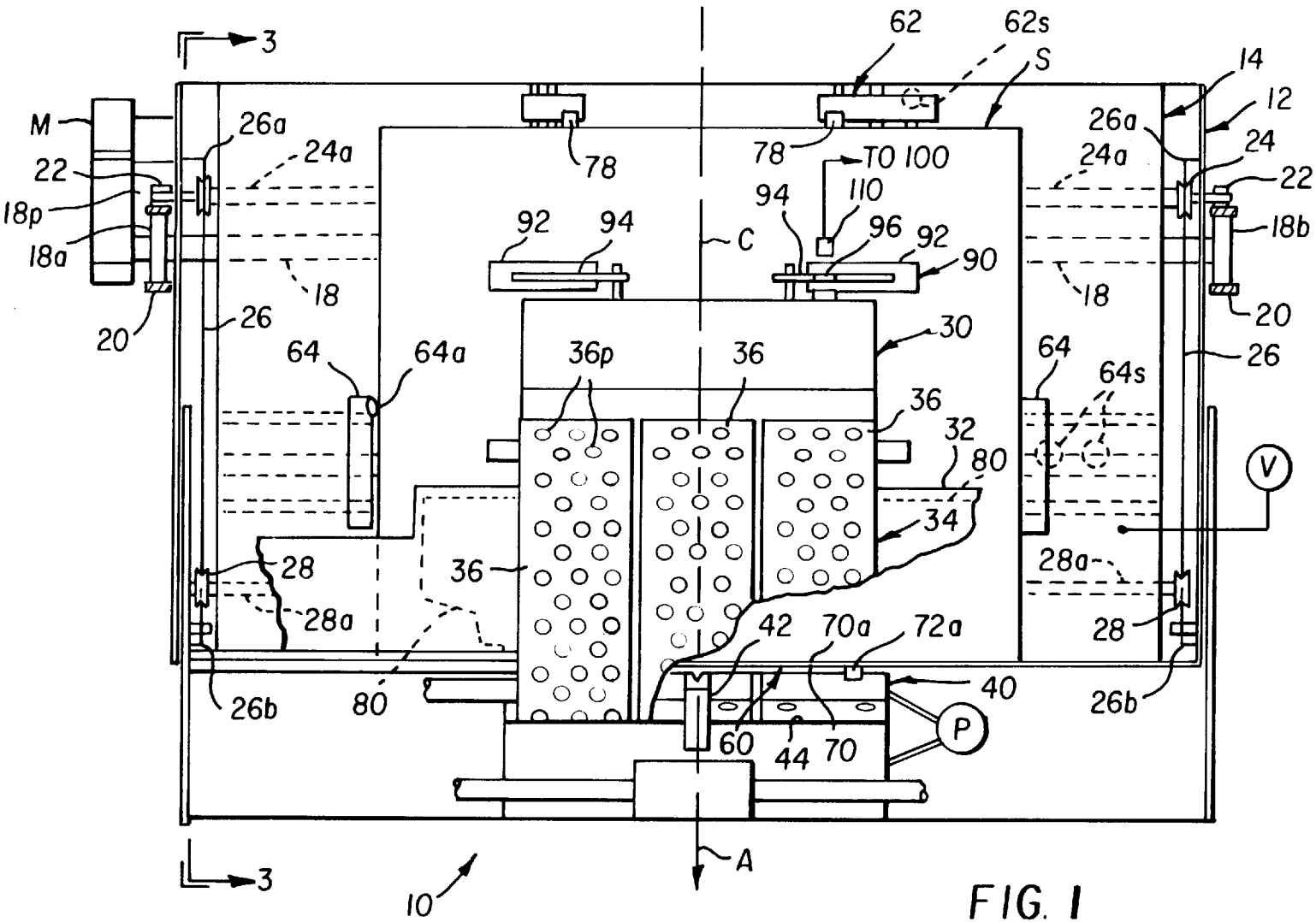
FIG. 1 is a top plan view of a top feed vacuum corrugated receiver sheet supply and feeding apparatus, including a mechanism for sensing sheet stack height and curl to accurately control sheet feed, according to this invention, with portions of such apparatus removed or broken away to facilitate viewing.
Figure 2:
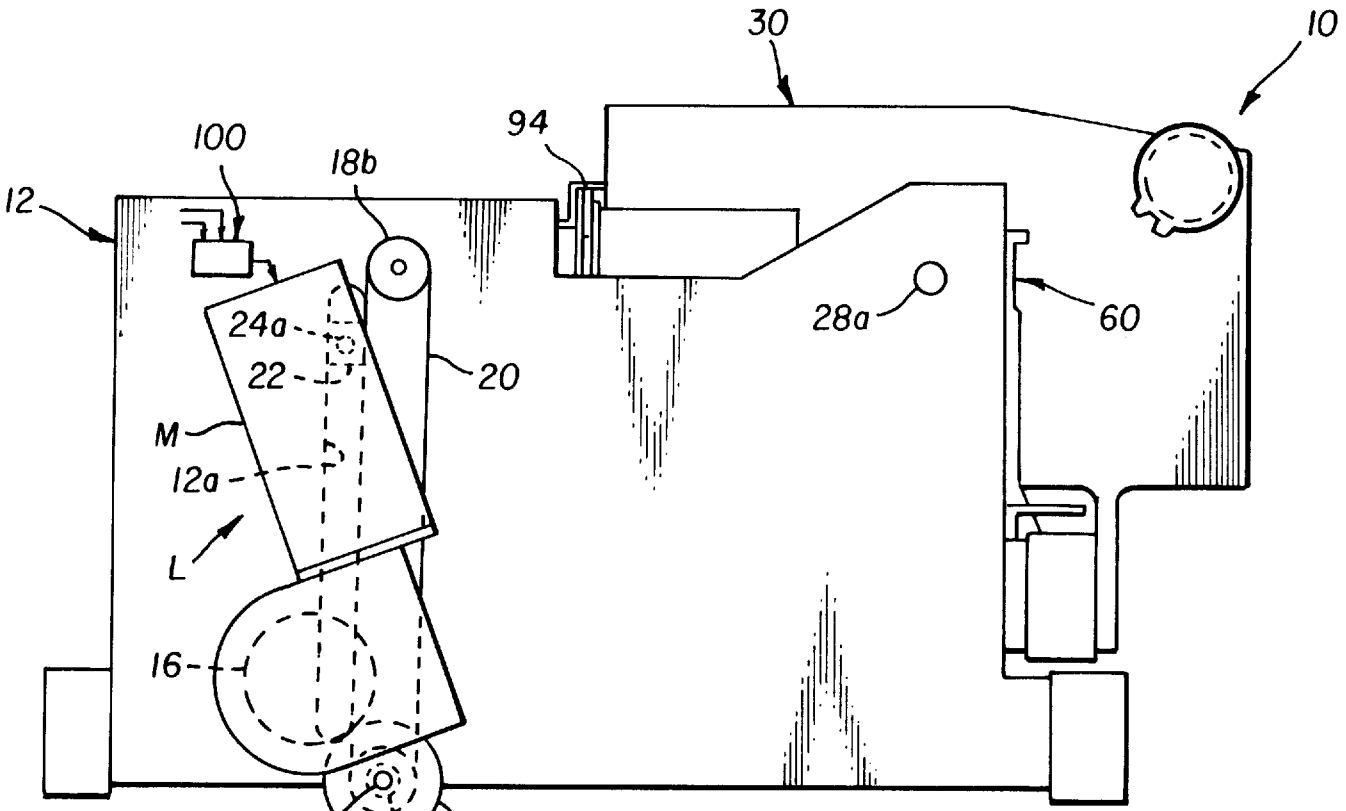
FIG. 2 is a side elevational view the top feed vacuum corrugated receiver sheet supply and feeding apparatus particularly showing the mechanism for moving the sheet stack supporting platform.
Figure 3:
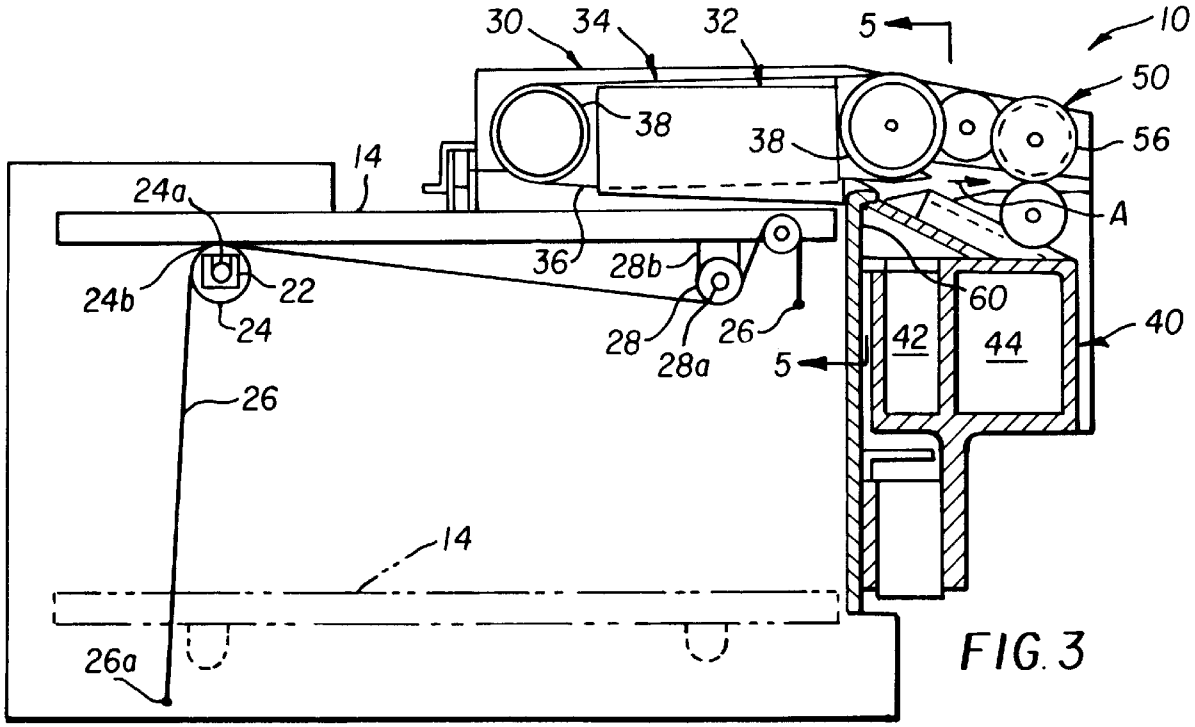
FIG. 3 is a side elevational view of a cross-section of the top feed vacuum corrugated receiver sheet supply and feeding apparatus of FIG. 1, taken along lines 3—3 of FIG. 1.

Referring now to the accompanying drawings, FIGS. 1, 2, and 3 generally show an exemplary top feed vacuum corrugated receiver sheet supply and feeding apparatus such as that disclosed in the aforementioned U.S. Pat. No. 5,344,133, for use with a reproduction apparatus of any well known type. Such top feed vacuum corrugated receiver sheet supply and feeding apparatus, designated generally by the numeral 10, is described herein only in such sufficient detail, and with appropriate modifications as are necessary to enable a full and complete understanding of the instant invention. The top feed vacuum corrugated receiver sheet supply and feeding apparatus 10 incorporates an open hopper 12 and an elevating platform 14 for supporting a stack of sheets. A sheet stack (designated by the letter S) supported on the platform 14 contains individual sheets suitable for serving as receiver sheets having reproductions formed thereon in a reproduction apparatus such as a copier or printer for example, or for separating or providing divisions in a copy set.

Sheets in the stack S may be selected from a wide variety of materials and sizes depending upon the desired end use. The sheet stack supporting platform 14 is supported within the hopper 12 for substantially vertical elevational movement by a suitable lifting mechanism L (see FIGS. 1 and 2).

The lifting mechanism L serves to raise the platform 14 to an elevation for maintaining the topmost sheet in the stack S at a predetermined level during operation of the apparatus 10, and lower the platform to permit adding sheets thereto. The lifting mechanism L includes a motor M, attached to the outside of the upstanding front wall of the hopper 12. The motor M rotates and output gear 16 in mesh with a gear 18*a* mounted on a shaft 18 extending from the upstanding front wall of the hopper 12 through the upstanding rear wall of the hopper. A pair of pulley mounted lifting chains 20 are respectively interconnected through gears 18*b* with the shaft 18 to be moved about a closed loop path when the shaft 18 is rotated by the motor M.

Each of the lifting chains has a link 22 extending through slots 12*a* respectively in the front and rear upstanding walls of the hopper 12. The links 22 are connected to respective pulleys 24 mounted on a shaft 24*a* supported in brackets 24*b* (see FIG. 3) extending from the underside of the platform 14. Tension cables 26 are respectively connected, at the ends 26*a*, 26*b* thereof, to the front and rear upstanding wall of the hopper 12. The cables are respectively threaded over their associated pulleys 24 and under pulleys 28 mounted on a shaft 28*a* supported in brackets 28*b* (see FIG. 3) extending from the underside of the platform 14.

In FIG. 3, the sheet stack supporting platform 14 is shown in its most elevated position in solid lines, and in its lowest position in phantom. During the operation of the lifting mechanism L, an appropriate signal to the motor M causes the motor to rotate the gear 16, either clockwise (in FIG. 2) to lower the platform 14 toward the lowest position or counterclockwise to raise the platform toward its most elevated position. Rotation of the gear 16 moves the lifting chains 20 in their closed loop paths imparting vertical movement to the links 22. This movement, in turn, moves the shaft 24*a*, and thus the platform 14 and its brackets 24*b* and pulleys 24. The platform 14 is maintained substantially level in its movement by the action of the tension cables 26 which cooperatively move the pulleys 28 and thus the shaft 28*a* and brackets 28*b* of the platform. A sensor, such as a potentiometer cooperating with the gear 16, produces a signal to indicate the instantaneous height of the platform 14. The use of this signal will be discussed below.

A lift assist spring 19, more fully explained below, is provided to aid in supporting the platform 14. Of course, other precisely actuatable lifting mechanisms, such as worm gears or scissors linkages, are suitable for use in elevation control for the sheet stack supporting platform according to this invention. The drive for the motor M to maintain the topmost sheet in the stack S supported on the platform 14 at the predetermined level (or to lower the platform) is accomplished by a control mechanism 100, according to this invention. The control mechanism 100 regulates operation of the motor M for actuating the lifting mechanism L, in the manner to be explained hereinbelow, to selectively raise the platform 14 through a predetermined increment or lower the platform.

A sheet feed head assembly, generally designated by the numeral 30, is located in association with the hopper 12 so as to extend over a portion of the platform 14 in spaced relation to a sheet stack supported thereon. The sheet feed head assembly 30 includes a ported plenum 32 connected to a vacuum source V, and an air jet device 40 connected to a positive pressure air source P. A positive pressure air jet from the device 40 levitates the top sheets in the supported sheet stack S, while vacuum at the plenum 32 is effective through to cause the topmost levitated sheet from the stack to thereafter be acquired at the plenum for separation from the sheet stack. Additional positive pressure air jets from the device 40 assure separation of subsequent sheets from the acquired topmost sheet.

Figure 5:
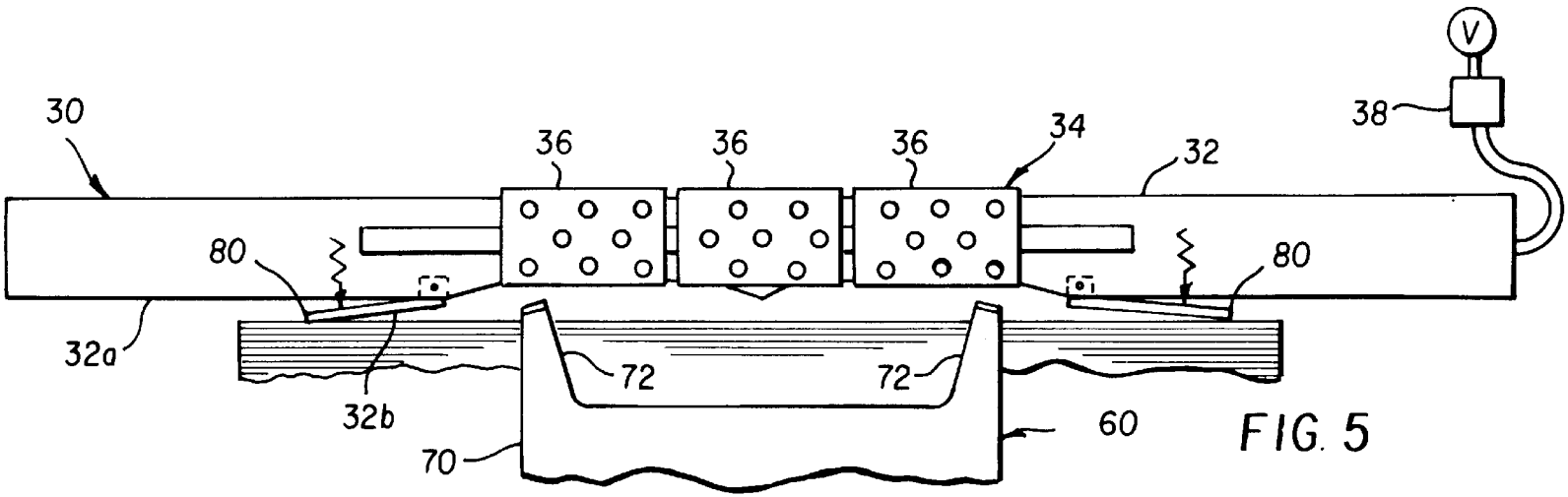
FIG. 5 is an end view, on an enlarged scale and with portions removed, of a portion of the receiver sheet supply and feeding apparatus, particularly showing the feed head assembly thereof, taken along the lines 5—5 of FIG. 3.

The lower surface 32*a* of the plenum 32 of the sheet feed head assembly 30 has a particularly configured shape (shown in FIG. 5) so as to provide for corrugation of an acquired sheet. Such lower surfaces of the plenum respectively include spring-urged plates 80 pivotably connected to the plenum. The plates 80 serve a dual function; that is, the plates (1) act on the sheet stack in a manner to increase the reliability of feeding of a wide range of sheet types, and (2) enable detection of the marginal edges of the sheet stack, for the purpose to be explained below.

With regard to the action of the plates 80 on the opposed marginal edges of the sheet stack S, as the top sheets in the supported sheet stack are levitated, the topmost sheet contacts the plates. An optimal pressure is exerted on the opposed marginal edges of the sheet parallel to the feed direction indicated by the arrow A (cross-track edges) by the plates 80 to help in forming a controlled corrugation to the sheet. The shape (location) of the plates 80 and the force which they exert on the sheet stack by the spring-urging is preselected to ensure reliable feeding for a wide range of sheet size and types. The pressure on the sheet stack by the plates is in the range which is sufficient to prevent uncontrolled lifting of the marginal edges from the remainder of the sheets in the stack, but less than an amount which would result in significant pinching of the sheets which may cause misfeeding or skewing of fed sheets. Similarly, the plates are shaped to assume a location (see FIG. 1) relative to the air jet device 40 in a spaced range sufficient to prevent misfeeds and/or uncontrolled lifting of the opposed marginal edges. The pressure exerted on the sheet stack by the plates 80, and their location, are selected such that the plates do not unduly inhibit the levitating air stream from passing through the sheet stack and out the rear thereof, as discussed below.

The controlled corrugation of the sheet establishes a consistent spacing for the center portion of the sheet from the center portion of the plenum 32. As such, the access time for a sheet to be acquired at the plenum is repeatably consistent and readily predictable. The interactions of the plenum 32, the air jet device 40, and a front stop (designated by the numeral 60) assure that control over the sheet as it is acquired at the plenum is never lost. Further, corrugation of the sheet contorts the sheet in an unnatural manner. Since subsequent sheets are not subjected to the same forces, at the same time, as is the topmost sheet, such subsequent sheets are unable to contort in the same manner. Accordingly, the subsequent sheets are effectively separated from the topmost sheet as it is being acquired at the plenum.

The sheet feed head assembly 30 additionally includes a belt mechanism 34 for transporting an acquired sheet in a feed direction (designated by the arrow A in FIGS. 1 and 3) away from the sheet stack S toward a downstream location. The belt transport mechanism 34 has a plurality of belts 36 entrained about rollers 38 to establish a closed loop path about the plenum 32. The lower runs of the belts 36 are in intimate contact with the lower surface 32*a* of the plenum 32 (see FIG. 5). The acquired sheet from the sheet stack S is effectively tacked to the belts by air pressure resulting from the application of vacuum in the plenum 32 through the plenum ports 32*p* and the belt ports 36*p*. The acquisition of the sheet is aided by the plates 80 which increase the impedance to air flow above the top of the sheet stack S into the vacuum plenum 32, and thus improve the efficiency of the vacuum action in acquiring the topmost sheet.

The belts 36 are selectively driven in a direction (counterclockwise in FIG. 3) to remove the acquired sheet from the area above the sheet stack S and transport the sheet in the feed direction A along a travel path to a downstream transport, such as driven feed nip roller pair 50. Accordingly, the belts 36 are selectively driven so as to feed an acquired sheet such that the acquired sheet is transported from the sheet stack S and is thereafter available for any further processing, such as receiving a reproduction from a copier or printer, for example.

The hopper 12 incorporates a front stop 60, a rear stop 62 and side stops 64 arranged to engage the marginal edges of a sheet stack S supported on the platform 14 and accurately locate the sheet stack in register relative to the sheet feed head assembly 30. The location of the side stops 64 are detected by a sensor 64*s*. The sensor 64*s* provides a signal representative of the position of the side stops, corresponding to the length (cross-track dimension) of the sheet stack. The use of this signal will be discussed below. The front stop 60 additionally provides a lead edge guide for the topmost sheet in the sheet stack as it is removed from the stack for acquisition, and also serves as a retard mechanism for any sheets adhering to the topmost sheet as it is removed. The positive pressure air jet device 40 of the sheet feed head assembly 30 is located adjacent to the front stop 60 on the opposite side thereof from the sheet supporting platform 14. As noted above, the air jet device 40 is for the purpose of levitating the top sheets in the sheet stack S and separating subsequent sheets adhering to the topmost sheet when acquired for removal from the sheet stack.

The positive pressure air jet device 40 includes a first air jet arrangement 42 and a second air jet arrangement 44. The first air jet arrangement 42 incorporates a single nozzle 42*a* in flow communication with a source of positive pressure air P. The nozzle 42*a* is located substantially along the center line C (see FIG. 1) of the sheet stack S, in the cross-track direction, and is aimed at the location where the top of the sheet stack will be positioned by the sheet support platform 14. The single nozzle 42*a* directs a high pressure air stream at the sheet stack, in the center of the lead edge, to fluff the top several sheets in the stack to bring the topmost sheet into association with the sheet feed head assembly 30 where it can be acquired, by vacuum, at the plenum 32.

The top sheets in the sheet stack S begin separation between each sheet and the topmost sheet rises, along its center line C, to a controlled height above the sheet stack. Once the sheets have started to levitate (fluff up) in the center, the topmost sheet will and the opposed marginal edges will lift the plates 80. Such lifting action continues until the down forces due to the plates (i.e., the weight and spring urging for the plates) are balanced by the up forces due to the air stream. The air flow going into the stack will ideally be allowed to proceed through the stack out the rear thereof, with some finding its way out through the sides of the stack.

Figure 4:
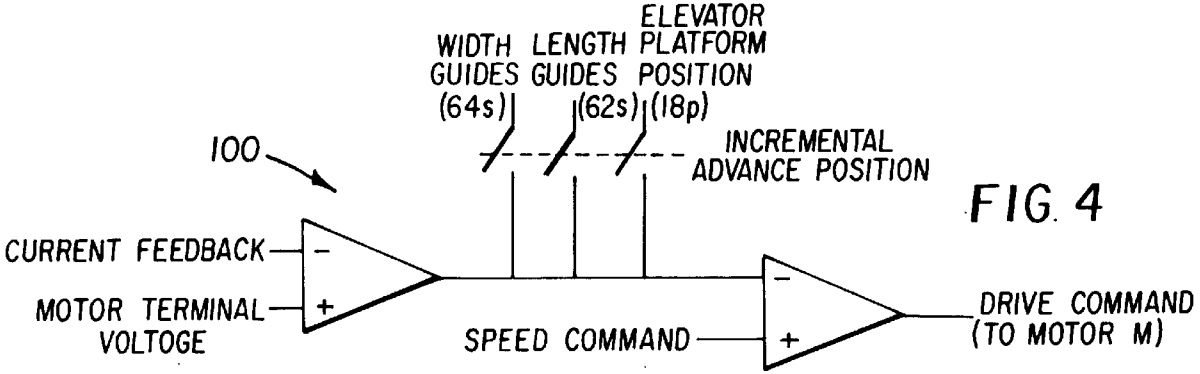
FIG. 4 is a schematic view of the sheet stack supporting platform control circuit.

The second air jet arrangement 44 incorporates a plurality of nozzles 44*a* (preferably six in number) in common flow communication with the source of positive pressure air P (or, alternatively, a second separate source of pressurized air). The nozzles 44*a* are aimed at the location where the top of the sheet stack will be positioned by the sheet support platform 14, and slightly downstream of the aim point for the first air jet nozzle 42*a* (see FIG. 4). The purpose of the second air jet arrangement 44 is to separate any sheets adhering to the topmost sheet acquired by the sheet feed head assembly 30 for removal and transport from the sheet stack S.

As noted above, the hopper 12 also incorporates a rear stop 62. The rear stop 62 is necessary to prevent sheets levitated from the sheet stack S by the first air jet arrangement 42 from moving toward the rear (relative to the sheet stack) by the positive air pressure exerted on the sheets. The rear stop 62 is adjustably mounted (on guide rods for example) for selective positioning in the sheet feed direction A so as to positively engage the rear edge of a sheet stack, of any of a variety of dimensions in the sheet feed direction, supported on the platform 14 and engaged at its lead edge with the front stop 60. The rear stop 62 is manually movable along guide rods to a selected position corresponding to a dimension of the sheet stack in the in-track direction (measured from the front stop 60). A sensor 62*s* detects the location of the rear stop 62. Sensor 62*s* produces a signal representative of the position of the rear stop 62, corresponding to the width of the sheet stack. The use of this signal will be discussed below. If desired, the rear stop 62 may include a loading device 78, such as a leaf spring, for exerting pressure on the top portion of the sheet stack S (and the levitated sheets) to assure that the sheets are maintained in register against the front stop 60.

The levitated sheets are maintained by the rear stop in their position relative to the sheet stack against the front stop 60. However, it is important that the positive air flow from the air jet device 40 between the levitated sheets be allowed to escape from the rear of the sheets. If the air flow were to be restricted, the corrugation of the topmost sheet will become unpredictable and thus the efficiency in acquiring the sheet by the sheet feed head assembly 30 will be substantially reduced. Accordingly, the rear stop 62 is formed as two substantially identical assemblies spaced apart on opposite sides of the supported sheet stack center line C. Of course, a single assembly with a large opening spanning the area through which the air flow can pass substantially unrestricted is also suitable for use with the apparatus 10.

Figure 7:
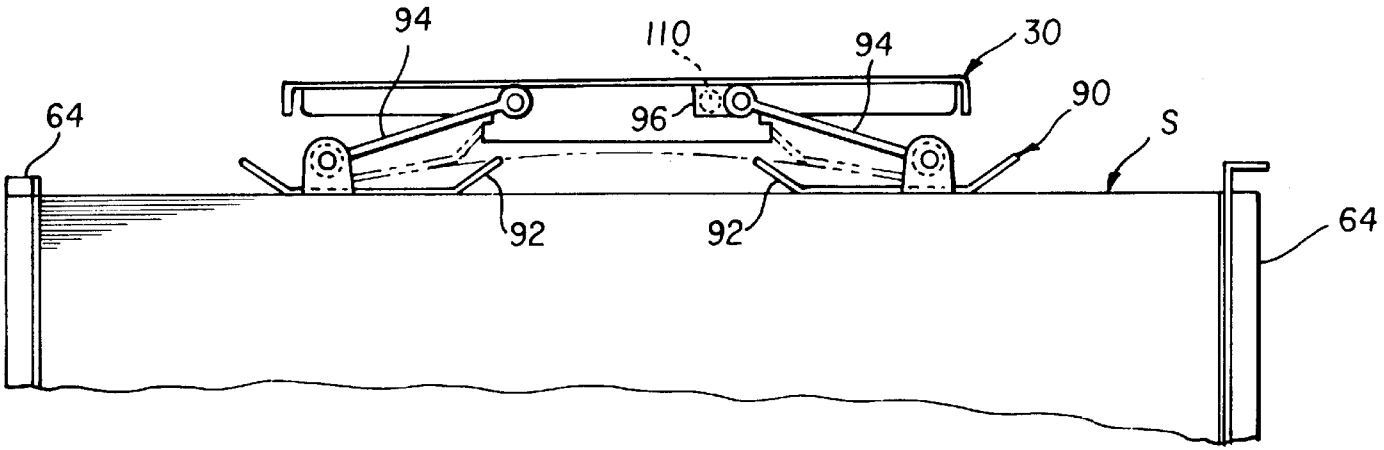
FIG. 7 is a rear elevational view of the apparatus shown in FIG. 6.

A device 90 (such as described in the provisional U.S. Pat. application Ser. No. 60/002109) is provided for facilitating handling sheets with the sheet supply and feeding apparatus 10 described above. The apparatus 90 (best seen in FIGS. 1, 6, and 7) includes a pair of weighted members 92*a*, 92*b* adapted to rest on the top of the sheet supply stack S supported on the platform 14. The weighted members 92*a*, 92*b*, configured generally in the shape of skis, are respectively connected by arms 94 to the feed head assembly 30 at the rear portion thereof. The respective arms 94 are pivotably connected at one end to the feed head assembly 30 and at the other end to a weighted member. As such, the weighted members 92*a*, 92*b* respectively extend from the feed head assembly 30 and readily follow the top of the sheet supply stack S as the topmost sheet is acquired by the feed head assembly. Specifically, FIG. 7 shows the sheet supply stack S with the weighted members 92*a*, 92*b* in engagement with the topmost sheet in solid lines before acquisition by the feed head assembly 30, and in phantom lines after the topmost sheet has been acquired by the feed head assembly.

Figure 6:
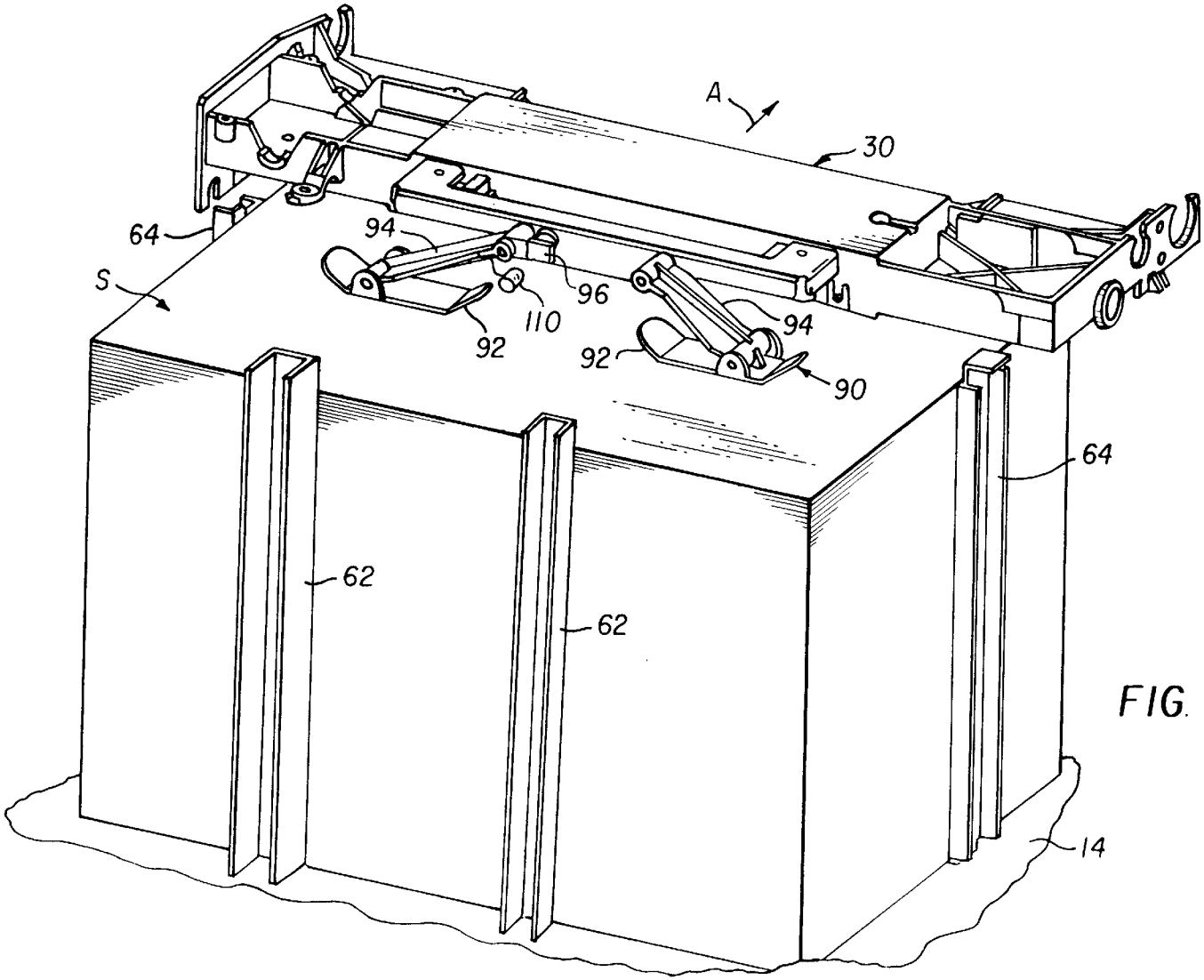
FIG. 6 is a view, in perspective, of the receiver sheet supply and feeding apparatus, particularly showing the sensor for detecting height of the sheet stack relative to the sheet feed head assembly, and the marginal edge curl sensors.

The location of the weighted members 92*a*, 92*b* is selected such that they respectively contact the sheet supply stack S upstream, in the direction of sheet feed (represented by the arrow A) from the sheet supply stack, of the feed head assembly 30 (see FIG. 6). The weighted members 92*a*, 92*b* apply a force to the sheet supply stack S, such force having at least a component in a direction relative to such sheet supply stack to prevent individual sheets (such as sheets of tab stock for example) in such stack from prematurely moving out of registered control of the feed head assembly 30. That is to say, as explained above, the separating air jets of the pressurized air jet device 40 direct a positive flow of air at the top portion of the sheet supply stack S in a direction having a component opposite to the direction of sheet feed by the feed head assembly 30. Further, the rear marginal edge of the sheet supply stack S may not be completely restrained by the rear stop 62 due to the unevenness resulting, for example, from tab portions of individual sheets. Thus, when the topmost sheet is acquired by the feed head assembly 30, individual sheets beneath the topmost sheet will be urged by the positive air flow in the direction opposite the feed direction. Accordingly, the weighted members 92*a*, 92*b* are arranged to prevent such sheets from moving out of the proper area for later registered acquisition by the feed head assembly which otherwise may lead to failure to subsequently acquire such sheets, or in misregistration of acquired sheets.

The weighted members 92*a*, 92*b* are arranged to act on the sheet supply stack S to maintain the individual top sheets, below the acquired sheet, in frictional engagement, at least over a portion thereof. As such, the weighted members confine the volumetric space, and thus the space for the air flow, between the acquired sheet and the subsequent sheets to increase the pressure on the stack beneath the acquired sheet. The increased pressure provides a significant friction force on the sheets in the sheet stack sufficient to counter the force of the positive air flow urging the sheets in the direction opposite to the feed direction. At the same time, the weighted members 92*a*, 92*b* will enable the acquired sheet to assume the desired corrugated shape and allow the positive air flow to pass through the sheet stack and out through the rear stop 62. As a result, individual sheets will be prevented from moving in the direction opposite to the feed direction, while the effectiveness of the positive air flow for sheet separation will not be negatively impacted.

As noted, it is important to maintain the topmost sheet of the sheet stack S on the supporting platform 14 within a specified operating window of stack travel to maintain reliable sheet feeding form the stack by the sheet feed head assembly 30. The operating window upper limit is determined by the minimum distance between the topmost sheet of the stack and the sheet feed head assembly 30, and the operating window lower limit is determined by the maximum distance between the topmost sheet and the sheet feed head assembly that would allow reliable acquisition of the topmost sheet thereby. The reliability of sheet feeding is dependent upon how closely the stack supporting platform lifting mechanism L maintains the topmost sheet within this operating window. Of course, maximum feeding reliability would be obtained by setting the operating window as narrow as feasible around the most favored operating point.

According to this invention, the examination of certain sheet stack parameters is useful in controlling stack height to maintain the topmost sheet at the desired operating point relative to the sheet feed head assembly 30 in order to provide for reliable feeding from a narrow operating window. The particular parameters that have been here selected for effective control are the height, width, and length of the sheet stack S. These parameters can be used individually, or together (representing, in effect, the weight of the stack) to modify the drive control for the motor M of the lifting mechanism L based on variations in the sheet stack. Specifically, the speed of the motor M is adjusted to accommodate for the weight of the sheet stack in order to minimize overshoot of the stack elevation by the lifting mechanism L in relation to the narrow operating window when the stack is incremented while feeding of sheets seriatim from the stack. A drive command that determines, for example, the terminal voltage of the motor M (and thus the output speed thereof) is correspondingly reduced as the particular sheet stack parameter (e.g., weight) is reduced. This action becomes more important as the maximum size of the sheet stack is increased to provide larger supply capacities on the platform 14 and/or for feeding large sized sheets. Of course other sheet stack parameters (such as the position of the stack, movement of the stack, thickness of sheets or number of sheets on the stack for example) may be utilized in accordance with this invention.

As described with reference to the preferred embodiment, the selected parameter for improving the control for the motor M of the lifting mechanism L for the drive for the sheet stack supporting platform 14 is the weight of the sheet stack supported on the platform 14. The maximum weight stack supported on the platform requires sufficient motor terminal voltage to lift the maximum load on the platform 14. However, the level of motor terminal voltage to provide for lifting of the maximum load would then provide a higher level of speed at lower levels of stack weight. Such higher motor speed would result in a reduction in the reliability for accurately controlling positioning of the platform within the desired narrow window of operation. Specifically, a speed higher than required would result in a larger amount of motor coast at the completion of the increment in stack position than would occur if the terminal voltage was reduced for the lighter stack weights. Therefore, stack weight information is used to alter the motor terminal voltage to obtain a less aggressive drive as the sheets are removed form the stack. That is, by altering the terminal voltage for the motor, based on the sheet stack weight parameters, the motor torque applied to the stack supporting platform 14 to elevate the platform is correspondingly altered in a manner which serves to incrementally elevate the platform (and thus the stack) over the range including the maximum stack weight condition to the minimum stack weight condition without resulting in excessive speeds for lighter stack weights.

The motor M of the lifting mechanism L for the sheet supply stack supporting platform 14 is a DC gear motor. The motor M operates to elevate the platform at a first speed to efficiently locate the topmost sheet in the sheet stack at an incremental advance position (i.e., the lower limit of the operating window). The first speed is generally set to be relatively fast so as to provide quick response time for location of the sheet stack at approximately the lower limit of the operating window (the platform is also lowered at this first speed to rapidly position the platform for reloading). The speed of the motor is then significantly reduced over the final travel of the platform to a second speed to locate the topmost sheet in the stack at the sheet level sensor 110 associated with the sheet feed head assembly 30 (i.e., the upper limit of the operating window). As sheets are fed from the stack on the platform 14 by the sheet feed head assembly 30, the stack level will approach the lower limit of the operating window. An appropriate signal is then produced to actuate the motor M to elevate the platform, at the second reduced speed, an incremental advance distance sufficient to raise the topmost sheet in the stack to the upper limit of the operating window.

The torque on the motor M is selected to be sufficient to drive the sheet stack supporting platform to the operating position at the level sensor 110 (i.e., the upper limit of the operating window) at the reduced second speed. The speed must be reduced sufficiently to substantially eliminate overshoot by the sheet stack relative to the level sensor actuating points during each incremental advance event so that the number of sheets fed between incremental advance events is minimized. Minimizing the number of sheets fed between incremental advance events minimizes the variability of the gap between the sheet feed head assembly 30 and the topmost sheet in the stack on the platform 14 during the sheet feeding operation.

As noted above, a lift assist spring 19 may be incorporated in the lifting mechanism L (see FIG. 2). The spring 19 is, for example, a torsion spring wrapped about the shaft 18 and coupled at one end to the shaft and at the other end to the gear 18*a*. As such, the torsion spring will provide a torque directly proportional to the distance between the supporting platform 14 and the sheet feed head assembly 30. When the platform 14 is driven down (lowered) by the motor M, the spring is torsionally wound to store the energy needed to assist the motor in raising the platform when supporting a sheet stack thereon. This spring assist partially accommodates for variations in stack thickness (weight) by reducing spring force as the sheets are fed from the stack on the platform 14 and the thickness of the stack accordingly decreases. The spring is designed to accommodate approximately one third to one half of the sheet stack load on the platform, while the motor M is required to handle the remaining stack load. The motor must accommodate the remaining paper stack load for various paper sizes (lengths and widths) requiring a large variation in motor torque for maximum to minimum paper stack weights respectively. Of course other types of lift assist springs are suitable for use with this invention. For example, the lift assist springs may be appropriately configured extension or compression springs.

In order to determine the required terminal voltage for the motor M, the appropriate sheet stack parameters are collected and transformed to the corresponding terminal voltage signal. With the stack weight selected as the desired terminal voltage determining parameter, the aforementioned signals from sensors 62*s* and 64*s* (which provide signals representative of the length and width for a particular sheet stack on the platform 14) are collected. Such signals are combined with a signal representing the height of the sheet stack on the platform 14 to yield a signal representative of the initial weight of the sheet stack. Of course, the length and width signals are constant for a given stack, but change as the size of the material with different stacks change. The drive command for the initial terminal voltage is accordingly decreased as the length and/or width of the stack material is decreased. After the initial terminal voltage is determined, as sheets are fed from the stack and the weight of the stack correspondingly decreases, the platform height signal from a platform height sensor (potentiometer associated with gear 16) is used to decrease the motor terminal voltage.

The length, width and height signals are not applied during the high speed travel of the stack to the incremental advance position (i.e., from the lowered location up to the lower limit of the operating window), but are electronically applied to the drive circuitry at and above the incremental advance position where the speed of the stack drive is reduced to the level desired for accurately incrementally advancing the topmost sheet of the stack within the desired narrow operating window for the feed head assembly 30. The drive thus maintains the top sheet on the stack within the incremental advance operating window during the feeding operation to assure reliable feeding.

Of course, other motors are suitable for use with this invention, such as for example a stepper motor where the clock rate thereof is altered based on a selected stack parameter. Further, the stepper motor can be sized to provide proper drive at desired speed with various stack weights by using the weight information. When a stepper motor is used to elevate the sheet stack supporting platform, the signals representing the length and width of a supported sheet stack (along with the height of the sheet stack) are only used to determine the representation of the stack weight to optimize the speed (step rate) over the high speed portion of the elevation of the platform so as to minimize the lift time from a down position to the incremental advance operating window. During the slow speed portion of the platform elevation (the incremental advance portion), the representation of the stack weight may be used to select a reduced idle current of the stepper motor to hold the stack at a location within the operating window. Reduction in the idle current results in a corresponding reduction in power consumption and heat generation by the stepper motor.

The invention has been described in detail with particular reference to preferred embodiments thereof, but it will be understood that variations and modifications can be effected within the spirit and scope of the invention as set forth in the claims.

What is claimed is:

1. A sheet feeder having a platform for supporting a stack of sheets, a feed head assembly for feeding sheets seriatim from the top of a sheet supply stack on said platform, means for moving said platform relative to said feed head assembly, and means for controlling operation of said platform moving means, said control means comprising:

means for determining a selected parameter of a stack of sheets supported on said platform and producing a signal corresponding to such parameter, said selected parameter determining means including means for substantially determining the area of the stack of sheets supported on said platform and producing a signal corresponding thereto, means for determining the height of the stack of sheets supported on said platform and producing a signal corresponding thereto, and means for summing the substantial area signal and the height signal to produce a signal substantially representative of the weight of the sheet supply stack; and means for setting the speed of said platform moving means based on said selected stack parameter signal.

2. The sheet feeder of claim 1 wherein, in said control means for said platform moving means, said means for determining the substantial area of the stack of sheets supported on said platform includes means for determining the length of a stack of sheets supported on said platform and producing a signal corresponding thereto, and means for determining the width of a stack of sheets supported on said platform and producing a signal corresponding thereto, and means for summing the corresponding length signal and the corresponding width signal.

3. The sheet feeder of claim 1 wherein said platform moving means includes a motor, and said speed setting means of said control means for said platform moving means includes means, operative as sheets are fed from said sheet stack supported on said platform thereby decreasing the weight of such sheet stack, for correspondingly decreasing the speed of said motor.

4. The sheet feeder of claim 1 wherein said platform moving means includes a motor, and said speed setting means of said control means for said platform moving means includes means for setting the speed of said motor at a first speed until said platform moves said sheet stack supported thereon into operative association with said feed head assembly, and thereafter setting the speed of said motor at a second, slower speed which is correspondingly decreased as sheets are fed from said sheet stack, supported on said platform, thereby decreasing the weight of such sheet stack.

5. The sheet feeder of claim 4 wherein said platform moving means further includes resilient means for assisting in the moving of said platform.

6. An apparatus for feeding sheets seriatim from the top of a sheet supply stack, said apparatus including means for supporting a sheet supply stack, a sheet feed head assembly having means for acquiring a sheets from the sheet supply stack and urging acquired sheets seriatim in a direction away from the sheet supply stack, a motor in operative association with said sheet stack supporting means for selectively elevating said sheet stack supporting means so as to maintain the topmost sheet in such stack at a predetermined level in spaced relation with respect to said acquiring and urging means of said sheet feed head assembly, and means for controlling operation of said motor for elevating said sheet stack supporting means, said control means comprising:

means for determining a selected parameter of a stack of sheets supported on said sheet stack supporting means and producing a signal corresponding thereto; and means for setting the speed of said motor at a first speed until said sheet stack supporting means elevates said sheet stack supported thereon into operative association with said sheet feed head assembly, and thereafter, in response to said selected stack parameter signal, setting the speed of said motor at a second, slower speed which is correspondingly decreased as sheets are fed from said sheet stack, supported on said sheet stack supporting means, thereby changing such parameter.

7. The sheet feeding apparatus of claim 6 wherein said motor is a DC motor, and said speed setting means of said motor control means includes means for correspondingly varying the terminal voltage of said DC motor based on said selected stack parameter signal.

8. The sheet feeding apparatus of claim 7 wherein, in said control means, said means for determining a selected parameter of said stack of sheets supported on said platform includes means for determining, substantially, the weight of such sheet stack.

9. The sheet feeding apparatus of claim 8 wherein, in said control means, said means for substantially determining the weight of said stack of sheets supported on said sheet stack supporting means includes means for substantially determining the area of the stack of sheets supported on said sheet stack supporting means and producing a signal corresponding thereto, means for determining the height of the stack of sheets supported on said sheet stack supporting means and producing a signal corresponding thereto, and means for summing the substantial area signal and the height signal to produce a signal substantially representative of the weight of the sheet supply stack.

10. The sheet feeding apparatus of claim 9 wherein, in said control means, said means for determining the substantial area of the stack of sheets supported on said sheet stack supporting means includes means for determining the length of a stack of sheets supported on said sheet stack supporting means and producing a signal corresponding thereto, and means for determining the width of a stack of sheets supported on said sheet stack supporting means and producing a signal corresponding thereto, and means for summing the corresponding length signal and the corresponding width signal.

11. The sheet feeding apparatus of claim 6 wherein said motor is a stepper motor, and said speed setting means of said motor control means includes means for correspondingly altering the clock rate thereof based on said selected stack parameter signal.

12. With an apparatus for feeding sheets seriatim from the top of a sheet supply stack, said apparatus including a platform for supporting a sheet supply stack, a sheet feed head assembly having means for acquiring a sheets from the sheet supply stack and urging acquired sheets seriatim in a direction away from the sheet supply stack, and a motor in operative association with said sheet stack supporting platform for selectively elevating said platform so as to maintain the topmost sheet in such stack at a predetermined level in spaced relation with respect to said acquiring and urging means of said sheet feed head assembly, a method for controlling operation of said motor for elevating said sheet stack supporting platform, said method comprising the steps of:

determining a selected parameter of a stack of sheets supported on said sheet stack supporting platform and producing a signal corresponding thereto;

setting the speed of said motor at a first speed until said motor elevates said sheet stack supporting platform to a location where said sheet stack supported thereon is in operative association with said sheet feed head assembly; and thereafter, in response to said selected stack parameter signal, setting the speed of said motor at a second, slower speed which is then correspondingly decreased as sheets are fed from said sheet stack, supported on said sheet stack supporting platform, thereby changing such parameter signal.

13. The method for controlling said motor for said sheet stack supporting platform of claim 12 wherein when said motor is a DC motor, said speed setting step includes the step of correspondingly varying the terminal voltage of said DC motor based on said selected stack parameter signal.

14. The method for controlling said motor for said sheet stack supporting platform of claim 13 wherein said step for determining a selected parameter of said stack of sheets supported on said platform includes the step of determining, substantially, the weight of such sheet stack.

15. The method for controlling said motor for said sheet stack supporting platform of claim 14 wherein said step of determining the substantial weight of said stack of sheets supported on said platform includes the steps of substantially determining the area of the stack of sheets supported on said platform and producing a signal corresponding thereto, determining the height of the stack of sheets supported on said platform and producing a signal corresponding thereto, and summing the substantial area signal and the height signal to produce a signal substantially representative of the weight of the sheet supply stack.

16. The method for controlling said motor for said sheet stack supporting platform of claim 15 wherein said step of determining the substantial area of the stack of sheets supported on said platform includes the steps of determining the length of a stack of sheets supported on said platform and producing a signal corresponding thereto, and determining the width of a stack of sheets supported on said platform and producing a signal corresponding thereto, and summing the corresponding length signal and the corresponding width signal.

17. The method for controlling said motor for said sheet stack supporting platform of claim 12 wherein when said motor is a stepper motor, said speed setting step includes the step of correspondingly altering the clock rate of the stepper motor based on said selected stack parameter signal.

* * * * *

UNITED STATES PATENT AND TRADEMARK OFFICE

CERTIFICATE OF CORRECTION

PATENT NO. : 5,823,527
DATED : October 20, 1998
INVENTOR(S) : Leroy E. Burlew
Michael T. Dobbertin Guy J. Rossi

It is certified that error appears in the above-identified patent and that said Letters Patent is hereby corrected as shown below:

Title page, --Related U.S. Application Date [60] Provisional Application No. 60/009,434, December 29, 1995--.

Signed and Sealed this

Twenty-fourth Day of August, 1999

*Attest:*

Q. TODD DICKINSON

*Attesting Officer*

*Acting Commissioner of Patents and Trademarks*